US008061102B2

(12) United States Patent
Turek et al.

(10) Patent No.: US 8,061,102 B2
(45) Date of Patent: Nov. 22, 2011

(54) ROOFING PRODUCT

(75) Inventors: Travis Turek, Webb City, MO (US); Adam Guenther, Webb City, MO (US)

(73) Assignee: TAMKO Building Products, Inc., Joplin, MO (US)

( * ) Notice: Subject to any disclaimer, the term of this patent is extended or adjusted under 35 U.S.C. 154(b) by 888 days.

(21) Appl. No.: 11/185,306

(22) Filed: Jul. 20, 2005

(65) Prior Publication Data

US 2005/0262790 A1 Dec. 1, 2005

Related U.S. Application Data

(63) Continuation-in-part of application No. 10/757,145, filed on Jan. 14, 2004.

(51) Int. Cl.
*E04D 1/00* (2006.01)

(52) U.S. Cl. ..... 52/560; 52/526; 52/535; 52/557

(58) Field of Classification Search ..... 52/518–528, 52/543–560, 535, 538; D25/138–140
See application file for complete search history.

(56) References Cited

U.S. PATENT DOCUMENTS 1,577,935 A * 3/1926 Runkle ..... 52/560
1,593,800 A * 7/1926 King ..... 144/13
1,661,770 A * 3/1928 Noble ..... 52/560
1,663,905 A * 3/1928 Dietz ..... 144/366
1,699,963 A * 1/1929 French ..... 52/543
1,785,830 A * 12/1930 Davis ..... 83/870
1,798,998 A * 3/1931 Batcheller ..... 428/141
1,802,494 A * 4/1931 Avery ..... 162/135
1,807,435 A * 5/1931 Robinson ..... 52/560
1,877,481 A * 9/1932 Prouty ..... 52/560
1,952,828 A * 3/1934 Volkhardt ..... 264/146
1,958,774 A * 5/1934 Whiting ..... 52/560
2,113,644 A * 4/1938 Bollaert ..... 52/558
2,142,996 A * 1/1939 Bussey ..... 52/521
2,168,218 A * 8/1939 Kirschbraun ..... 52/560
2,171,010 A * 8/1939 Schuetz et al. ..... 52/555
2,241,603 A * 5/1941 Kirschbraun ..... 52/560
(Continued)

*Primary Examiner* — Jeanette E. Chapman
(74) *Attorney, Agent, or Firm* — Husch Blackwell LLP

(57) ABSTRACT

A starter block and a shingle are utilized to form courses that may be positioned in overlapping fashion on a roof to form a roofing covering system. The particular design of the starter block and shingle result in a roofing product that provides increased durability over previous designs. The starter block may be formed with top and bottom surfaces, opposite side surfaces with tapering heights, and a front surface having a greater height than a back surface of the starter block. When the starter block is coupled to a roof deck, a semi-rigid shingle having a generally planar bottom surface may be placed upon the starter block so that a portion of the shingle extends off of the starter block over the back surface thereof and onto the roof deck to facilitate contact between the shingle and the roof deck at a location more proximal to the starter block back surface than if the same back surface had the same height as the front surface. Additionally, the semi-rigid shingle may have an exposed portion and a headlap portion, with the exposed portion extending from a forward shingle edge to the headlap portion and the headlap portion extending from a back shingle edge to the exposed portion. The exposed portion has a central region with a generally uniform thickness moving in the longitudinal direction. Unlike the exposed portion, the headlap portion has a taper in average thickness moving in the longitudinal direction. The taper extends for at least a substantial part of the headlap portion.

2 Claims, 5 Drawing Sheets

U.S. PATENT DOCUMENTS

| | | | | | |
|---|---|---|---|---|---|
| 2,421,417 | A | * | 6/1947 | Fasold et al. | 52/546 |
| 2,437,874 | A | * | 3/1948 | Black | 52/525 |
| 3,841,885 | A | * | 10/1974 | Jakel | 106/663 |
| 3,852,934 | A | | 12/1974 | Kirkhuff | |
| 3,943,677 | A | * | 3/1976 | Carothers | 52/309.4 |
| 4,034,528 | A | * | 7/1977 | Sanders et al. | 52/309.4 |
| 4,279,106 | A | | 7/1981 | Gleason et al. | |
| 4,391,076 | A | * | 7/1983 | Ferguson | 52/553 |
| 4,499,702 | A | * | 2/1985 | Turner | 52/555 |
| 5,295,340 | A | * | 3/1994 | Collins | 52/518 |
| 5,615,523 | A | * | 4/1997 | Wells et al. | 52/98 |
| 5,992,116 | A | * | 11/1999 | Ternes et al. | 52/518 |
| 6,021,611 | A | * | 2/2000 | Wells et al. | 52/98 |
| 6,164,034 | A | * | 12/2000 | Roetheli et al. | 52/560 |
| 6,213,707 | B1 | | 4/2001 | Liehs et al. | |
| 6,530,189 | B2 | | 3/2003 | Freshwater et al. | |
| 2004/0148874 | A1 | | 8/2004 | Jolitz et al. | |
| 2004/0258883 | A1 | | 12/2004 | Weaver | |
| 2005/0089672 | A1 | | 4/2005 | Kuipers et al. | |
| 2005/0115182 | A1 | * | 6/2005 | Heiland | 52/518 |

* cited by examiner

ROOFING PRODUCT

CROSS-REFERENCE TO RELATED APPLICATIONS

This application is a continuation-in-part of U.S. application Ser. No. 10/757,145, filed Jan. 14, 2004, and entitled "Starter Block Roofing Product."

STATEMENT REGARDING FEDERALLY SPONSORED RESEARCH OR DEVELOPMENT

Not applicable.

BACKGROUND OF THE INVENTION

The present invention relates to a roofing product. More specifically, the present invention is directed to the combination of a tapered starter block and a tapered shingle combined in courses to form a roofing system for a pitched roof.

Roofing shingles that are used to provide a protective environmental barrier layer for a pitched roof typically fall into one of the following categories: asphalt, wood shake, slate and composite shingles. Asphalt shingles often have little structural rigidity and provide a look to a roof that is less natural than wood shake or slate shingles. Composite shingles, as well as wood shake and slate shingles, are somewhat rigid in nature and have increased thickness as compared to asphalt shingles. The appeal of composite shingles is that a roof may be formed to replicate a wood shake or slate roof while providing a highly durable roofing product that is often less expensive and lower maintenance than a comparable shake or slate roof.

When installing a shingled roof covering system on a pitched roof, a starter course, or row, is usually coupled to a roof deck along the eaves to form a base for the first course of full shingles. With asphalt shingles, the starter course may be composed of shingles that have been cut so that they have a shorter length than the standard shingle. The flexible nature of asphalt shingles allows the first course to overlie the starter course and flex downwardly over the back edge of the starter course to contact the roof deck underlying the roofing system just rearwardly of the starter course (i.e., towards the roof apex or ridgeline). Additional shingle courses are applied to partially overlap the previous courses as the roofing installer works their way up to the ridgeline.

Significantly more difficulty arises in the installation of semi-rigid to rigid shingles with a starter course. Wood shake or composite shingles, which have a more significant thickness and rigidity than asphalt shingles, may be cut into a starter course at an installation site, but such cutting is time consuming and labor intensive. In the case of slate shingles, such cutting may not even be possible without special tools.

Another issue is that more rigid shingles do not lie flat on the starter course while maintaining some contact with the roof rearwardly of such starter course. As can be seen in FIG. 1, a traditional roofing system of semi-rigid shingles includes a starter course 10 nailed to the eave 510 of a roof deck 500, a first course of shingles 15 coupled to the roof deck 500 and additional shingle courses 20 coupled to the roof deck 500 moving up the roof deck 500. Each shingle course 15, 20 may be coupled to the roof deck 500 either by nailing to the underlying course (e.g., starter course 10) and/or directly to the roof deck 500 rearwardly of the course. This configuration creates both an exposed gap 25 and a hidden gap 30. The exposed gap 25 is formed between the first shingle course 15 and the starter course 10, and becomes increasingly larger moving down the starter course 10 due to the angle at which each shingle 15 lies when contacting both the roof deck 500 and a back edge 35 of the starter course 10. The angle of lie of each shingle 15 also forms the hidden gap 30 between the respective shingle 15 and the roof deck 500. Though the installation of additional shingle courses 20 to overlie the previous shingle course, additional hidden gaps 30 are formed.

Both the exposed gap 25 and the hidden gap 30 create unique problems. The exposed gap 25 allows wind to provide a lifting effect on the shingles 15, potentially pulling them off of the roof deck 500 or causing a structural failure due to high stresses at the point of attachment of the shingle 15 with the roof deck 500 or starter course 10. By nailing down shingles 10 towards a forward edge 40 thereof, the exposed gap 25 could be largely eliminated. This would be disadvantageous, however, for two reasons. First, the downward bending of the forward region of the shingle 15 creates high stresses laterally across the shingle 15 above the back edge 35 of the starter course 10. Also, the nails used to secure the shingle 15 in the forward region would be directly exposed to the outside environment, creating both a pathway for moisture to penetrate the starter course 10 and the roof deck 500 and an undesired aesthetic effect. The overlying shingle course (e.g., course 20) could be lengthened to overlie the nailing location of the shingle 15, but with additional material expense and labor. With respect to the hidden gap 30, the relatively large height of the gap 30 positions only a small portion of the rearward region, or headlap, of the overlying shingle 15, 20 in contact with the roof deck 500. Large impact loads incident on the shingle courses, such as those used in Underwriters Laboratories, Inc's.® ("UL") 2218 specifications, also knows as the Class 4 impact resistance test, create high stresses on the shingles above the hidden gap 30. The Class 4 impact resistance test is meant to replicate a hailstorm hitting a roof, but may also give an indication of the resistance of roofing products to impact loads from other objects (e.g., tree branches, persons walking on the roof, etc.). With the traditional roofing system arrangement shown in FIG. 1, the stresses of impact loading are concentrated laterally across the shingle 15, 20 where the shingle overlies the back edge of the underlying course (e.g., back edge 35). Because there is little surface area of the shingle headlap that is in contact with the roof deck 500, impact load distribution is poor across the shingle 15, 20, making it difficult to reduce the stress concentrations.

Therefore, it would be beneficial to provide a product that would eliminate exposed gaps 25 in a roofing system and reduce the stress concentrations in shingles due to the presence of a large hidden gap 30. Additionally, it would be beneficial to provide a product that accomplishes the above and that is usable with different types of shingles and capable of being produced in numbers.

SUMMARY OF THE INVENTION

Improved roofing system performance is achieved through usage of the tapered thickness starter block and shingle of the present invention. The starter block may be applied as a first course to a pitched roof at an eave, and then subsequent courses of the shingles applied in overlapping sequences up the roof towards the ridgeline. The starter block and the shingle may each be formed from composite materials, and capable of being mass-produced and finished in a number of ways. For example, the starter block and the shingle can be fabricated to provide may the appearance of a slate or wood shake shingle. One material combination that is suitable for forming the starter block and the shingle is to use at least a polymer component (e.g. thermoplastics, polyolefins) and a filler component (e.g., glass, stone, limestone, talc, mica, cellulosic materials).

In one aspect, the starter block has top and bottom surfaces, opposite side surfaces with tapering heights, and a front surface having a greater height than a back surface of the starter block. Because the front and back surfaces are generally rectangular, and the top and bottom surfaces are generally planar, the side surfaces taper in height moving from the front surface to the back surface. Therefore, when the starter block is coupled to a roof deck, the placement of a semi-rigid shingle having a generally planar bottom surface upon the starter block so that a portion of the shingle extends off of the starter block over the back surface thereof and onto the roof deck facilitates contact between the shingle and the roof deck at a location more proximal to the starter block back surface than if the same back surface had the same height as the front surface.

In another aspect, the semi-rigid shingle has an exposed portion and a headlap portion, with the exposed portion extending from a forward shingle edge to the headlap portion and the headlap portion extending from a back shingle edge to the exposed portion. The exposed portion has a central region with a generally uniform thickness moving in the longitudinal direction. Unlike the exposed portion, the headlap portion has a taper in average thickness moving rearwardly in the longitudinal direction. The taper extends for at least a substantial part of the headlap portion.

The taper of the starter block thickness, therefore, functions to reduce the size of the hidden gap formed behind the starter block back surface and beneath the shingle. In addition, the tapering allows a first course of shingles to lie flat upon the top surface of the starter course and eliminate an exposed gap between the shingle bottom surface and the starter course top surface. The tapering of the thickness of the shingle also reduces the size of the hidden gap formed behind the back edge of an underlying course of shingles and beneath an overlying course of shingles. Therefore, with the tapering thickness of both the starter block and the shingle, more surface area of the headlap portion of the shingles can contact the underlying roof deck and better distribute impact force loads incident upon the roofing system.

Additional advantages and novel features of the present invention will in part be set forth in the description that follows or become apparent to those who consider the attached figures or practice the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

The present invention provides a starter block and a shingle each designed with a tapered thickness for improving the performance of a roofing system. The starter block is configured for use in the starter course of a roofing project to facilitate the subsequent positioning of shingles on the roof. More specifically, the tapered thickness of the starter block and selective tapering of the shingle thickness allow for shingle installation without substantially bending, stressing or breaking the shingles, while also providing a durable design capable of withstanding strong impact loads from above. The starter block and shingle design preferably incorporate the use of composite materials to enable mass-production and the realization of efficiencies in forming roofing products with a more complex geometry (i.e., with a taper).

Figure 2:
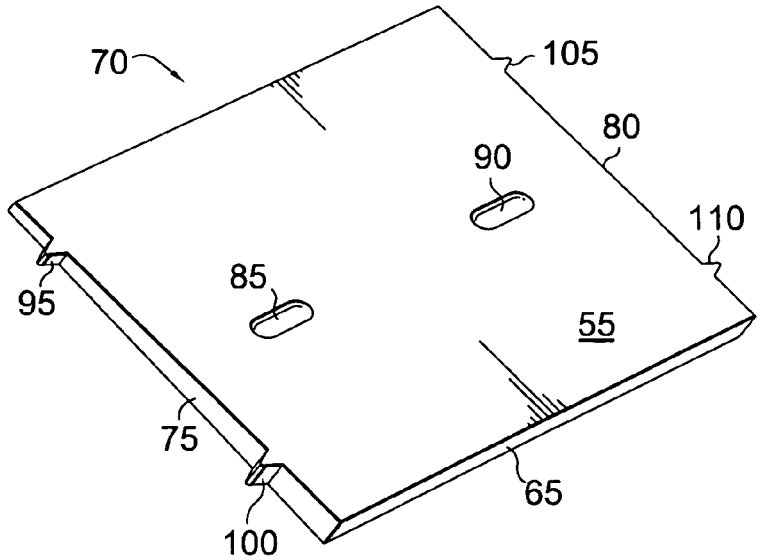
FIG. 2 is a perspective view of one embodiment of a starter block of the present invention.
Figure 3:
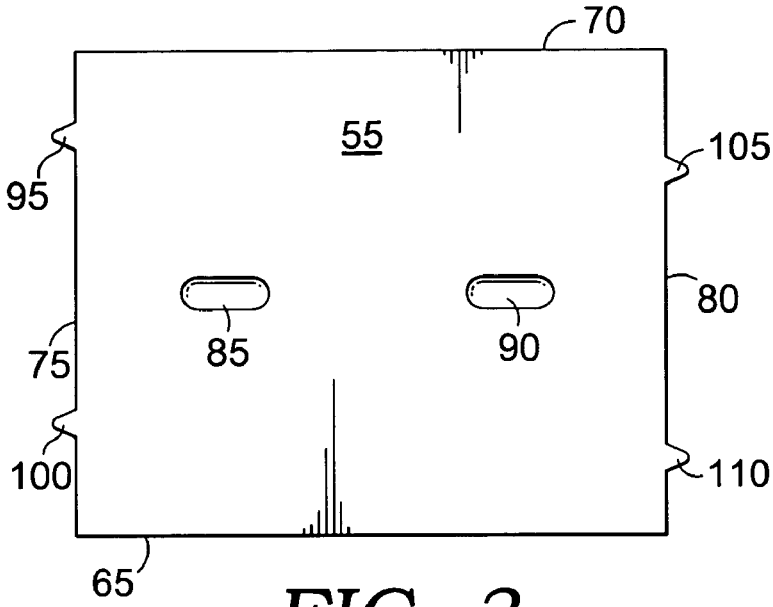
FIG. 3 is a top plan view of the starter block of FIG. 2.
Figure 4:
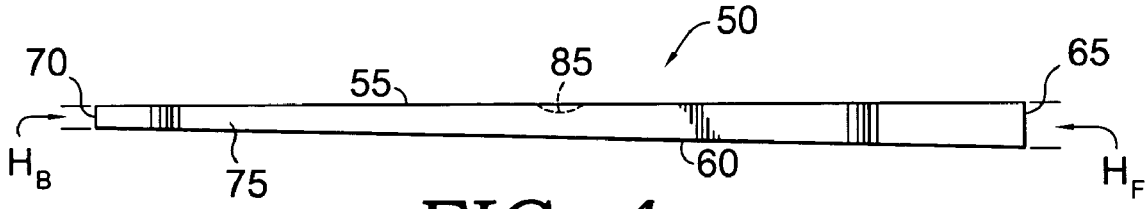
FIG. 4 is a side elevational view of the starter block of FIG. 2.

As seen in FIGS. 2, 3 and 4, one embodiment of the starter block of the present invention is generally denominated by the numeral 50. Starter block 50 includes a top surface 55, a bottom surface 60, a front surface 65 and a back surface 70. These surfaces are generally rectangular, and may have some variation in shape and in surface features (e.g., texturing, indentations, etc.). In the embodiment of the starter block 50 shown in these figures, the starter block is a solid. However, the starter block 50, for instance, may have a cavity formed in bottom surface 60 to reduce the amount of material necessary to form the starter block 50.

Continuing with the figures, starter block 50 includes two non-rectangular side surfaces 75 and 80, with side surface 80 generally being a mirror image of side surface 75. As seen in FIG. 3, the height $H_F$ of front surface 65 is greater than the height $H_B$ of back surface 70. Accordingly, the heights of side surfaces 75 and 80 decrease or taper moving rearwardly from the front surface 65 to the back surface 70.

Starter block 50 may also include one or more nailing zones 85, 90 located on top surface 55. Nailing zones 85 and 90 are areas in which starter block 50 can be fastened to a roof by using a nail or any other suitable device. Nailing zones 85 and 90 are generally positioned on top surface 55 so that starter block 50 will be adequately secured to the roof, and also so that an overlaying shingle covers the nailing zones 85 and 90. Nailing zones 85, 90 may be indented into the top surface 55 of the starter block 50. The elongated oval shape for nailing zones 85, 90 shown in the figures is exemplary, and it is understood that other shapes may be implemented in the present invention.

Another feature that may be included in the design of the starter block 50 are one or more nibs or tabs 95, 100, 105 and 110 extending from side surfaces 75 and 80 respectfully. In particular, each of nibs 95, 100, 105 and 110 generally includes angled sides that converge at an apex or pointed end extending outwardly from side surfaces 75 and 80 respectively. Nibs 95 and 100 may be spaced apart at generally the same distance that separates nibs 105 and 110, however, nibs 95 and 100 are preferably located at a different distance from back surface 70 than nibs 105 and 110. In other words, nibs 95 and 100 are longitudinally offset from nibs 105 and 110, respectively. This nib spacing ensures that when a set of starter blocks 10 are placed upon a roof deck laterally adjacent to one another, the angled sides of the nibs contact one another to align the back surfaces 70 thereof and set the position of the starter course moving up the pitched roof. Alternatively, one or more nibs may be positioned on only of the side surfaces 75 or 80 of the starter block 50. The layout of the starter course will be explained more fully below.

Figure 5:
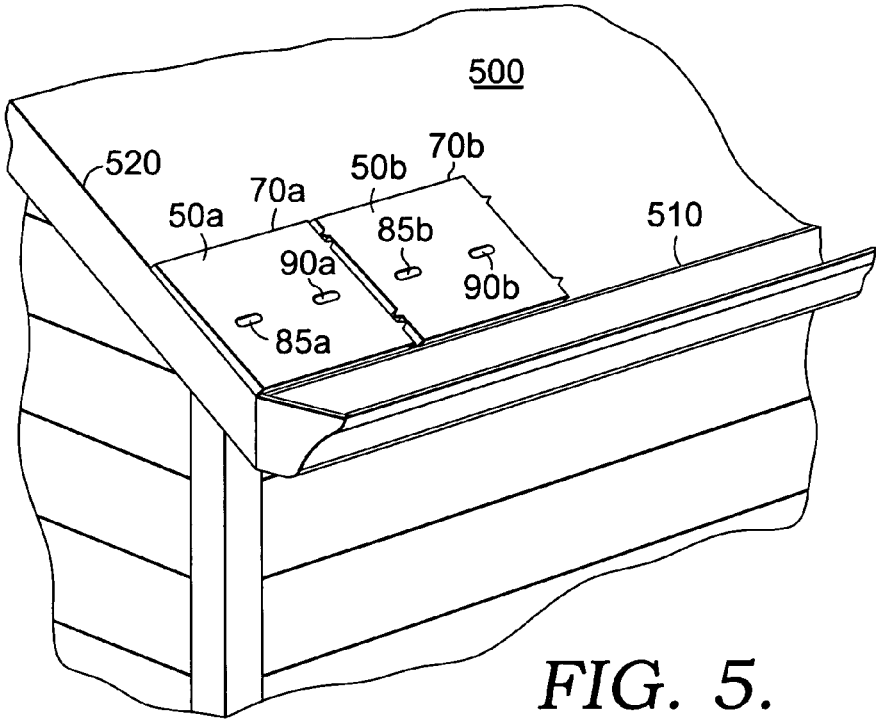
FIG. 5 is a perspective view of multiple starter blocks of FIG. 2 illustrating an installation technique for positioning a first course of a roofing system at an eave of a pitched roof.

Referring now to FIG. 5, the starter block 50 is intended for use as a foundation layer for a first course of shingles in a roofing project. Thus, at the start of a roofing project, starter block 50*a* is placed at the eave 510 of a pitched roof deck 500 adjacent to side edge (or rake) 520. After such placement, starter block 50*a* is coupled to roof deck 500, most likely by applying one or more nails through starter block 50*a* and into roof deck 500 (e.g., into plywood sheeting or other underlayment). It should be noted that starter block 50*a* includes optional nailing zones 85*a* and 90*a*. Accordingly, the nails that couple starter block 50*a* to roof deck 500 most likely would penetrate starter block 50*a* at nailing zones 85*a* and 90*a*. Because nibs 95, 100 on the left side 75 of the block 50*a* are not necessary with the first block of a course, as the side surface 75 is generally aligned with the side edge 520 of the roof deck 500, nibs 95, 100 may be removed (e.g., cut off) so that they do not protrude off of the side edge 520.

Next, starter block 50*b* is placed at bottom edge 510 of roof deck 500 laterally adjacent to starter block 50*a*. Both starter block 50*a* and 50*b* have nibs on their adjacent side surfaces. After starter block 50*b* is placed on roof deck 500, it is moved laterally until its nibs are in contact with starter block 50*a* and the nibs on starter block 50*a* are in contact with starter block 50*b*. In this manner, the nibs ensure that there is proper spacing between the two starter blocks 50*a* and 50*b* and may be positioned to, when in contact along their respective angled sides, indicate whether the back surfaces 70*a* and 70*b* of the starter blocks 50*a* and 50*b* are in alignment. After starter block 50*b* is in proper position, starter block 50*b* may be coupled to the roof deck 500 in the same manner as starter block 50*a*, for instance by nailing through nailing zones 85*b* and 90*b*. Additional starter blocks 50 may then be placed on and coupled to roof deck 500 until the starter course extends the entire length of eave 510 laterally across the roof deck 500.

Figure 6:
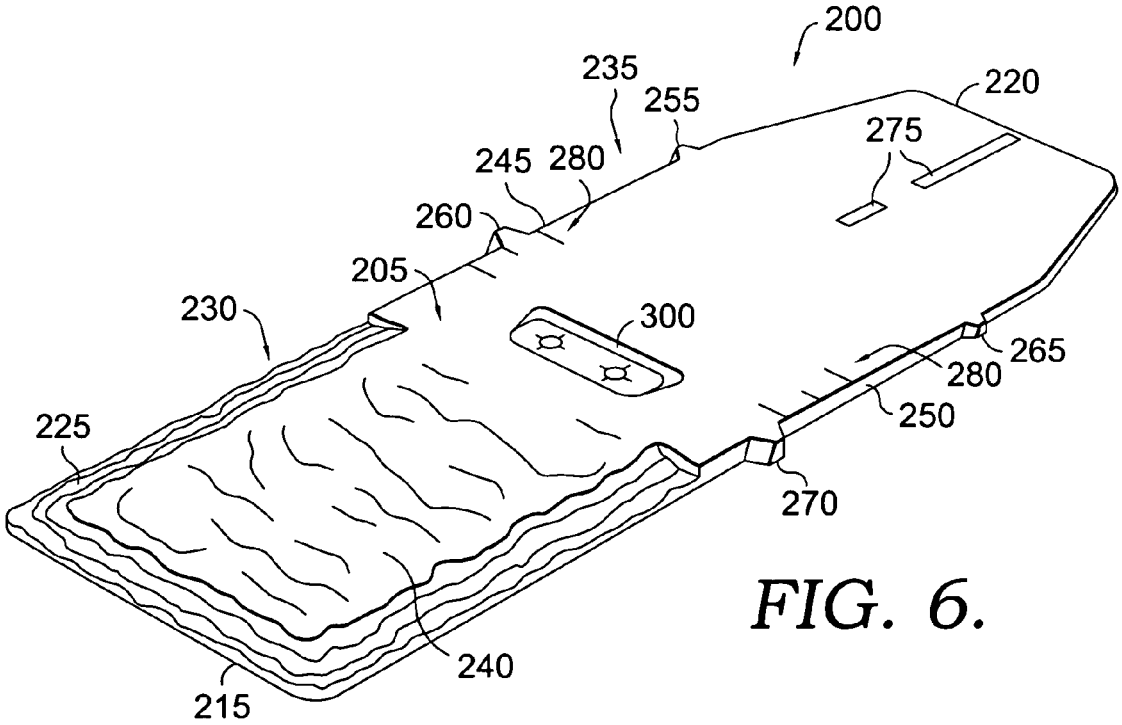
FIG. 6 perspective view of one embodiment of a shingle of the present invention.
Figure 9:
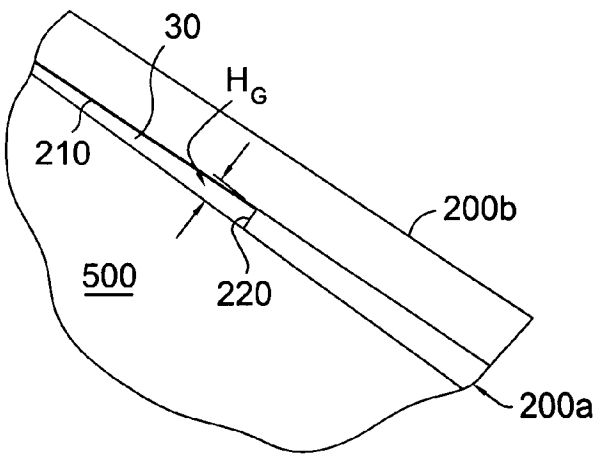
FIG. 9 is a close-up view in the areas designated by the reference numeral 9 showing the height of the hidden gap.
Figure 8:
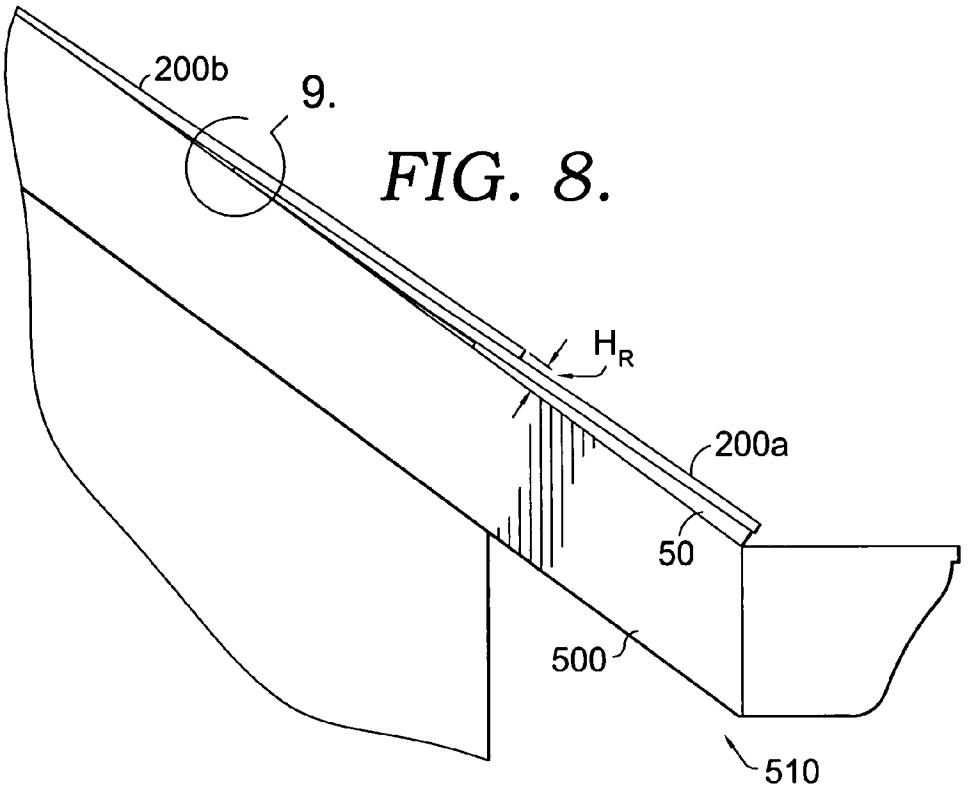
FIG. 8 is a side elevational view of a roofing system employing courses of the starter block and the shingle of the present invention.
Figure 7:
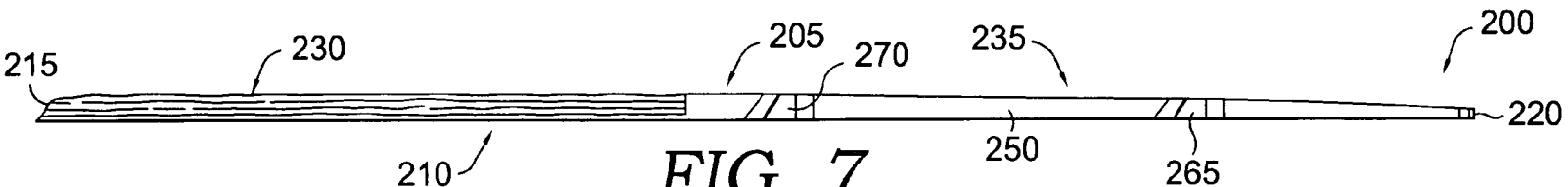
FIG. 7 is a side elevational view of the shingle of FIG. 6.

One embodiment of a semi-rigid shingle 200 of the present invention is shown in FIGS. 6 and 7, and installed on a pitched roof with a starter course in FIGS. 8 and 9. The structural features of the shingle 200, and the advantages provided by the use of the starter block 50 and shingle 200 in combination for a roofing system will be discussed in more detail below.

As referenced above, starter block 50 and shingle 200 are preferably formed from composite materials. Suitable materials include, but are not limited to, rubber (e.g., ground up tire rubber), polymers such as polyolefins (e.g., various grades of polyethylene, recycled or virgin), fillers (e.g., glass, stone, limestone, talc, mica, cellulosic materials such as wood flour, rice hulls, etc.), asphalt embedded mats, or tile. In one embodiment, the composite material makeup includes at least a polymer component and a filler component. Coloring agents may also be added to the mixture so that the composite product more closely resembles a particular type of shingle. For example, for a composite slate product, a gray color may be added to the mixture. Similarly, for a composite wood shake product, a brown color may be added to the mixture. Other additives or processing methods may be added or applied to improve reflection, heat deflection or other weathering characteristics, (e.g., UV inhibitors and stabilizers). These material combinations form the starter block 50 and shingle 200 into semi-rigid objects. As used herein, the term semi-rigid refers to roofing products having a range of rigidity, from nearly completely rigid will little deflection under load to a somewhat rigid object that will deflect to a certain degree under load (especially where the materials thickness is the thinnest). A significant amount of the rigidity of the starter block 50 and shingle 200 is derived from the filler material.

The starter block 50 and shingle 200 may be made and cut, or molded, to shape using various fabrication techniques. For example, one manner of making the starter block relies on the use of a mixer and extruder. The ingredients that are used to form the starter block are mixed in the mixer (e.g., a kinetic mixer) and then passed through the extruder. The mixture emerging from the extruder may be sliced into small pellets by a rotary knife so that the material can be more easily conveyed through piping under air pressure or suction to a storage location for use when needed (e.g., in a storage bin). Thereafter, the pellets are extracted from storage and fed to an injection-molding machine along with coloring agents where the material is injected in one or more molds that have been cast or machined, such as by digitized molding, to have the desired shape of the roofing product (starter block 50 or shingle 200). Each mold may also have surfaces formed with certain texturing or contouring simulating certain types of shingles such as slate or wood shake shingles. For instance, the mold for producing slate shingles may have an acid etch process applied to certain surfaces, as taught in U.S. patent application Ser. No. 10/853,690, the teachings of which are incorporated herein by reference. After curing and sufficient cooling, the molded roofing product is removed from the mold and bundled or otherwise packaged with like roofing products (starter block 50 or shingle 200) for shipment or storage. Of course, as is known in the field, the above-stated steps may be automated. Moreover, many other methods of making composite versions of starter blocks and shingles are also within the scope of the present invention, such as those described in U.S. patent application Ser. Nos. 10/387,823 and 10/457,728, the teachings of which are incorporated herein by reference.

Returning to FIGS. 6 and 7, one embodiment of the semi-rigid shingle 200 includes a top surface 205, a bottom surface 210, a forward edge 215 and a back edge 220. In the exemplary composite shingle arrangement show in the figures, the shingle 200 is configured to resemble a natural slate shingle by having certain irregular layering or terracing 225 around the perimeter of a portion of the shingle, as well as surface texturing. The semi-rigid shingle 200 is formed with an exposed portion 230 and a headlap portion 235. Exposed portion 230 is designed to be the part of the shingle 200 that is exposed or viewable once installed on a roofing project, and headlap portion 235 provides a location for attachment of the shingle 200 to the roof deck 500 (either through an underlying course or directly to the roof deck 500) as well as support for an overlying course, as can be seen in FIG. 8. Similar to the starter block 50, the shingle 200 may have a cavity formed in bottom surface 210 to reduce the amount of material necessary to form the starter block 50. In any case, the bottom surface 210 is preferably configured with an in-plane portion (e.g., a perimeter edge surrounding the cavity, if present, or otherwise substantially the entire surface) so that the shingle 200, once installed, generally lies evenly across and in contact with the underlying course and/or the roof deck 500. For instance, if no cavity is present, bottom surface 210 may be generally planar across the entire surface.

The exposed portion 230 of the shingle 200 has a central region 240 that presents a substantially uniform thickness in the longitudinal direction between the terracing 225 and the transition to the headlap portion 235. For instance, in one embodiment, the thickness variation is merely due to surface texturing or other minor features resultant of manufacturing processes of the shingle and/or efforts to form the shingle as resembling a natural material shingle (e.g., slate or wood shake). In any case, the central region 240 substantially does not taper in thickness. A tapering thickness for the exposed shingle portion 230 results in inconsistent material strength across the backbone of the exposed portion 230 (i.e., the central region 240), which must take direct impact loads if the UL 2218 specifications are to be met. Additional shingle layers could be installed if a tapered exposed portion 230 was utilized, but these layers would add labor and expense in a roofing project and may further cause undesirable aesthetic effects if multiple shingles with tapered exposed portions are stacked on top of one another. In one exemplary configuration, the central region 240 of the exposed portion 230 has a thickness of around 0.25 inches. However, it is understood that the exposed portion 230 may have a thickness that is greater or less than 0.25 inches, depending on the desired physical characteristics of the shingle 200, but still substantially without a thickness taper.

In contrast to the exposed portion 230, the headlap portion 235 tapers in average thickness across the headlap moving longitudinally towards the shingle back edge 220. Preferably, an indented nailing zone 300 is located in the headlap portion 235 near the transition to the exposed portion 230, and the taper in thickness begins rearwardly of the nailing zone 300 and continues to the back edge 220. Opposed side surfaces 245 and 250 of the shingle 200 are generally formed in the headlap portion 235 as wedge shaped due to the taper of the headlap. In one exemplary configuration, the side surfaces 245 and 250 have a height of around 0.25 inches in the region where the exposed portion 230 transitions to the headlap portion 235 (i.e., near the nailing zone 300) and thereafter taper moving rearwardly to a height of around 0.09 inches at the intersection with the back edge 220. Preferably, the top and bottom surfaces 205, 210 are generally planar so that the heights of the side surfaces 245 and 250 at a given longitudinal position correspond with the average thickness across the headlap portion 235 at that position, except for surface indentations formed in the top surface 205 (e.g., nailing zone 300). Alternatively, if bottom surface 210 is formed with a cavity, then the heights of the side surfaces 245 and 250 at a given longitudinal position preferably correspond with the average height across the headlap portion 235 at that position, the height of the headlap portion 235 being measured between the in-plane portion of the bottom surface 210 (i.e., at the perimeter edge surrounding the cavity) and the top surface 205.

The width of the headlap portion 235 narrows near the back edge 220 due to an angling inward of the side surfaces 245 and 250 laterally towards one another, as seen in FIG. 6. The narrowing of the width allows the shingle 200 to be gripped by a roofing installer at the intersection of the back edge 220 and one of the side surfaces 245 or 250 and held freely with less deflection of the shingle 200. In another exemplary configuration, the side surfaces 245 and 250 have a height of around 0.11 inches at the point where the shingle width begins to narrow due to the side surfaces 245 and 250 angling inwardly.

Aiding in installation of course of the shingles 200 on a roof deck 500, the headlap portion 235 may also include one or more nibs or tabs 255, 260, 265 and 270 having generally the same configuration as the nibs 95, 100, 105 and 110, respectively of the starter block 50. The nibs 255 and 265, are preferably longitudinally offset from nibs 260 and 270, respectively, ensuring that, when nibs of laterally adjacent shingles 200 of a given course are in contact with one another, the back edges 220 of the shingles 200 are aligned to set the position of the course of shingles moving up the pitched roof. The shingles 200 may also be configured to have nibs on only one of the side surfaces 245 and 250, such as for a first shingle 200 of a given course aligned with the with the side edge 520 of the roof deck 500. In that case, the nibs 255, 260 of the side surface 245 may be removed (e.g., cut off) so that they do not protrude off of the side edge 520.

The headlap portion 235 of the shingle 200 may also be provided with one or more longitudinal laying lines 275 and transverse 280 scale ticks. Laying lines 275 are preferably formed at the longitudinal centerline of the shingle 200 and with sufficient width as to be easily seen when installing courses of shingles. A drawn line or indentation in the top surface 205 may be used to form the laying lines 275. The function of the laying lines 275 is for creating a laterally offset alignment of an overlying course of shingles 200 with respect to the underlying shingle course. In other words, laying lines 275 position the overlying shingle course to cover a gap formed between the side surfaces 245 and 250 of laterally adjacent shingles 200 of the underlying course in the region of the headlap portion 235 of the underlying shingle course. Scale ticks 280, on the other hand, designate a longitudinal offset between the overlying course of shingles 200 and the underlying shingle course by providing a measure of overlap of the overlying shingle course moving up the pitched roof. A length measurement number, for example in inches, may be located next to each scale tick 280 to designate the selected amount of shingle 200 overlap. In this way, when the shingle 200 of the overlying course is positioned on the underlying shingle 200 such that the scale tick 280 is aligned with the back edge 220 of the underlying shingle, the associated number will indicate the degree of shingle overlap at that position.

A first course of shingles **200*a* may be coupled to the roof deck 500 over the starter block 50 course shown in FIG. 5, the buildup of shingle courses on the starter course now being depicted in FIG. 8. For instance, shingle installation may be made by nailing through nailing zone 300 and into either the underlying starter block 50 or directly into the roof deck 500 depending on the degree of overlap of the shingle 200. The nibs 255, 260, 265 and 270 may be used in the same manner as the nibs of the starter block 50 to align laterally adjacent shingles 200 of the first course moving across the roof deck 500. As referenced above, the first shingle in a course aligned with the side edge 520 of the roof deck 500 may have the nibs 255, 260 on the side surface 245 removed. Once installation of the first course of shingles 200*a* is completed, a second course of shingles 200*b* may be installed utilizing, in one embodiment, the laying lines 275 of the underlying first course of shingles 200*a* to laterally position shingles 200 of the second course, and the scale ticks 280 on the second course of shingles 200*b* to determine the degree of longitudinal overlap with respect to the first course of shingles 200*a***. Thereafter, further shingle courses may be installed.

Figure 1:
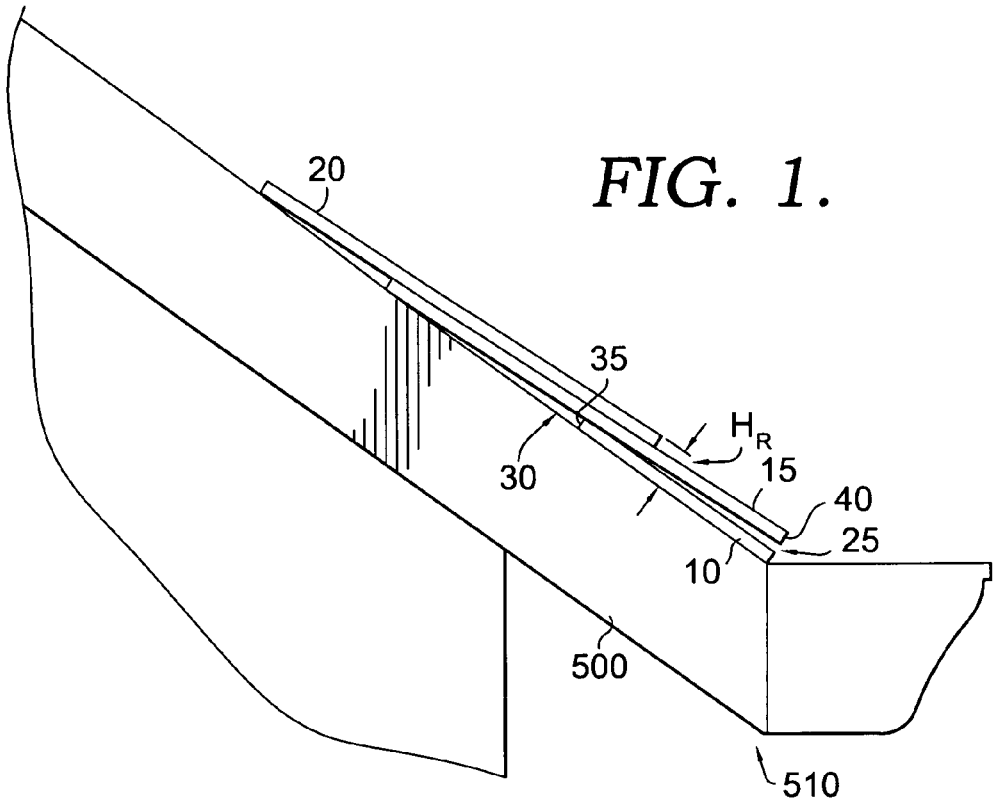
FIG. 1 is a side elevational view of a prior art roofing system employing a conventional starter course and shingle course build-up.

With particular attention to FIGS. 8 and 9, the advantages of the shingle 200 having a tapered thickness headlap portion 235 used in combination with a tapered thickness starter block 50 can be understood. The tapering of the starter block 50 moving rearwardly eliminates the exposed gap 25 (seen in FIG. 1) by allowing a first course shingle **200*a* contacting the roof deck 500 rearwardly of the back surface 70 to lie flat upon the top surface 55 of the starter block 50. By eliminating the exposed gap 25, wind is prevented for substantially reaching the bottom surface 210 of the shingle 200*a* and prying the shingle 200 off of the roof deck 500. Having the shingle 200*a*** lie flat upon the starter block 50 also inhibits water from reaching the nailing zones 85 and 90, which may cause weakening of the attachment nails and a potential path for the water to reach the roof deck 500.

The starter block 50 taper also reduces the peak height $H_G$ of a hidden gap 30 formed behind the starter block back surface 70 and between the shingle bottom surface 210 of the first course and the roof deck 500 from a value equal to the thickness across an untapered starter block to a value equal to the height $H_B$ of back surface 70 of the tapered starter block 50. The tapering of the headlap portion 235 of each shingle 200 course also reduces the peak height $H_G$ of the hidden gap 30 behind the back edge 220 of an underlying shingle course (e.g., first course of shingles 200*a*) and between the shingle bottom surface 210 of an overlying shingle course (e.g., second course of shingles 200*b*) and the roof deck 500. As can be seen in FIG. 9, the peak height $H_G$ of the hidden gap 30 with the roofing system of the present invention is much less than the thickest portion of the overlying shingle 200 course (e.g., shingle 200*b*). This is in contrast to the prior art embodiment of FIG. 1 where the hidden gap 30 peak height is generally equal to the thickness of an untapered shingle 15 or starter course 10. Reducing the height $H_G$ of the hidden gap 30 allows the headlap portion 235 of the shingle 200 directly over the gap 30 to have a greater surface area of contact with the roof deck 500. This allows the shingle 200 to better distribute the stresses of impact loads incident on the roofing system across the shingle 200, and away from the portion of the shingle directly over the starter block back surface 70 or shingle back edge 220. The tapered headlap portion 235, being thinner than an untapered shingle 15, 20, also deflects to a greater degree under a given load, further enabling the shingle 200 to contact a broader surface of the roof deck 500 for transferring vertical loads thereto. Still further, the tapering of the starter block 50 (and depending on the degree of shingle course 200 overlap, the tapering of the shingle headlap portion 235) also lowers the total height $H_R$ of the build up of roofing layers as compared to the roofing layers height $H_R$ of the constant thickness shingles 15, 20 and starter block 10 of the prior art shown in FIG. 1. Because the speed of wind across a surface is generally reduced as the vertical distance from the surfaces is reduced, due to frictional drag forces, lowering the roofing layers height $H_R$ provides the advantage of placing reduced wind loads on the roofing system.

Figure 10:
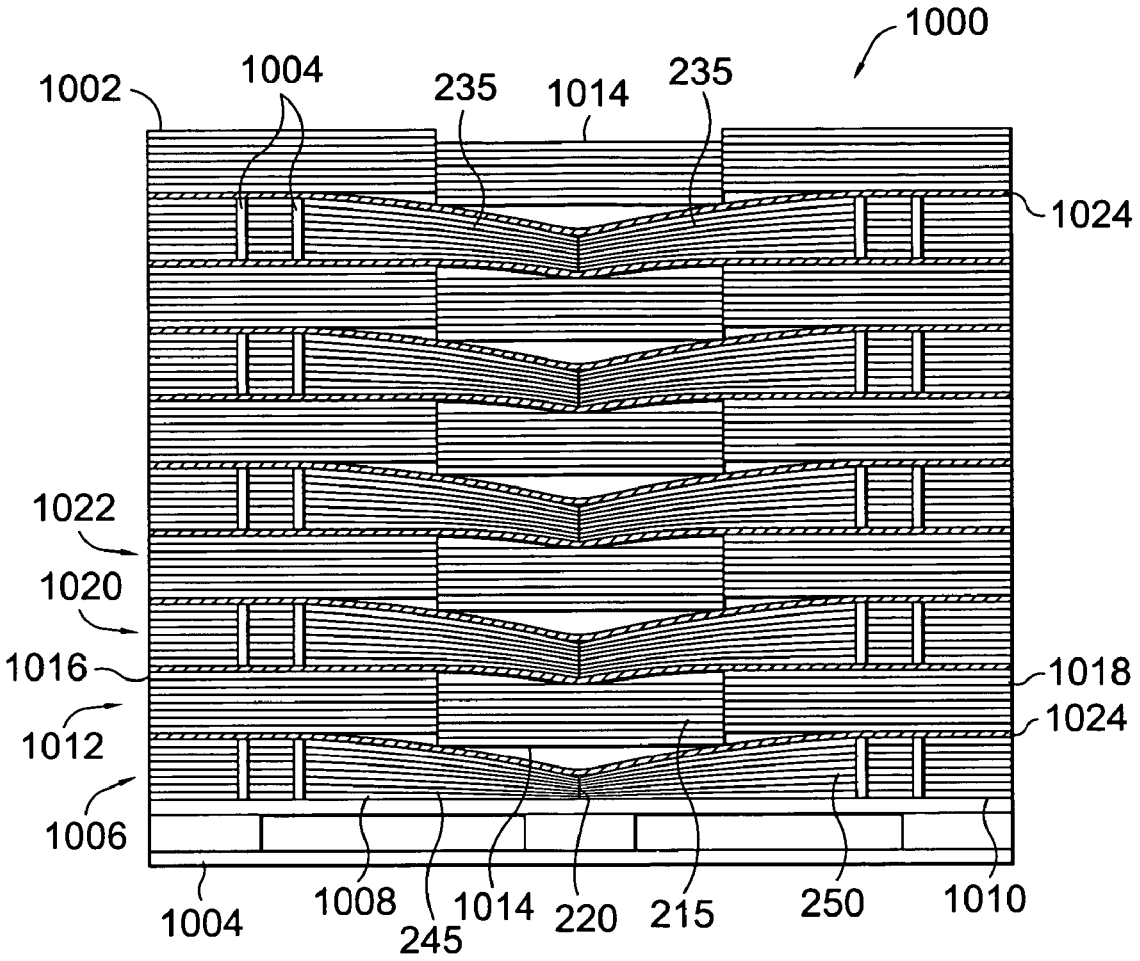
FIG. 10 is a side elevational view of a stacking arrangement for shingle bundles.

Continuing with FIG. 10, a stacking arrangement 1000 for bundles 1002 of shingles 200 is provided that advantageously forms a gradual arcuate bow in the longitudinal dimension of the shingles 200. This arcuate bow has been found to be beneficial to roofing installers because the front and back edges 215 and 220 of the shingle 200 maintain good contact with an underlying surface when placed upon the surface (e.g., the roof deck 500). Without good contact between the underlying surface and the shingle front and back edges 215 and 220, the shingle bottom surface 210 tends to slide around easier on the underlying surface, making attachment of the shingle 200 to the roof deck 500 more difficult.

During the manufacturing process, molded shingles 200 are conveyed to a location where they are stacked one on top of the other with their edges in alignment to form the bundle 1002. A set of bands 1004 (e.g., made of plastic or metal) may be used to hold a given number of shingles 200 together and maintain the geometry of the bundle 1002. The bands 1004 preferably extend around the bundle 1002 width at the thicker part of the shingles 200, i.e., at the exposed portions 230.

One preferred method for stacking is to form layers of bundles 1002 on a pallet 1004 where each layer in the stack is aligned orthogonally or perpendicularly to the preceding layer. For example, a first bundle layer 1006 is formed with two rows 1008 and 1010 of bundles 1002, each row being rotated 180 degrees on the pallet 1004 with respect to the other row so that the back edges 220 of the shingles 200 of a given bundle 1002 of the first row 1008 face the back edges 220 of the shingles 200 of the corresponding bundle 1002 of the second row 1010. In one arrangement, each row 1008 and 1010 has three bundles 1002 for a total of six bundles 1002 in the first bundle layer 1006 of the stacking arrangement 1000.

A second bundle layer 1012 likewise has multiple rows of shingle bundles 1002, including a center row 1014 flanked on opposite sides by perimeter rows 1016 and 1018. Each row 1014, 1016 and 1018 extends in the same direction on the pallet 1004 as the underlying rows 1008 and 1010 of the first bundle layer 1006, but the shingle bundles 1002 themselves of the second bundle layer 1012 are oriented orthogonally or perpendicularly to the orientation of the shingle bundles 1002 of the first layer 1006. Thus, as can be observed in FIG. 10, the forward edges 215 of the shingles 200 of the bundles 1002 of the second layer 1012 are aligned generally with the side surfaces 245 and 250 of the singles 200 of the bundles 1002 of the first layer 1006. These orthogonal bundle 1002 orientations continue with successive bundle layers on the pallet 1004. For instance, a third bundle layer 1020 is oriented in the same fashion as the first bundle layer 1006, and a fourth bundle layer 1022 is oriented in the same fashion as the second bundle layer 1012. If the pallet 1004 were rotated 90 degrees, it would be observed that the second bundle layer 1012 has the same appearance as the first bundle layer 1006, except for the vertical sagging of the center row 1014 with respect to the perimeter rows 1016 and 1018. This phenomena also continues with successive bundle layers (e.g., third and fourth bundle layers 1020, 1022).

It is the downward weight load of the center row 1014 of each bundle layer above the preceding layer, along with the weight of the headlap portions 235 of the shingle bundles 1002 resting on the center rows, that forms the longitudinal arcuate bow in the shingles 200 of each bundle 1002. This compressive force may also cause the center rows 1014 to be vertically displaced downwardly due to sagging of the supporting shingle headlap portions 235, enhancing the formation of the arcuate bow for each shingle 200 of the bundles 1002. Slip sheets 1024, such as cardboard sheeting, may also be placed on top of a given bundle layer (e.g., first layer 1006) before a new layer of shingle bundles (e.g., second layer 1012) are placed on the preceding layer. The slip sheets 1024 help spread the compressive load out across the headlap portions 235 of the shingle bundles 1002, and if desired, may be configured to prevent excessive sagging beyond the desired amount.

In another embodiment, if enough shingles 200 are put into each bundle 1002 of the first bundle layer 1006 (or successive odd numbered layers), the second bundle layer 1012 (and even numbered layers thereafter) may consist of just the center row 1014 of shingle bundles 1002 on top of the headlap portion 235 of the shingles 200 of the below layer of bundles 1002. Therefore, the top of the center row 1014, if few enough shingles are placed in the bundles 1002 of the row 1014, would be no higher than the top of the first bundle layer 1006 in the region of the exposed portions 230 of the shingle bundles 1002, and would occupy the space below the third bundle layer 1020.

It is to be understood that the bowing may form the bottom surface 210 of the shingle 200 with a degree of arc in the longitudinal direction, though much of the arc may be flattened out when the shingle 200 is coupled to the roof deck 500. Descriptions of the shingle bottom surface 210 as being generally planar or having an in-plane portion are intended to include bottom surface shapes that have a modest degree of arc that becomes substantially flattened out once shingle installation is accomplished, such as the depiction of shingle 200 directly overlying starter block 50 in FIG. 8.

As can be seen, the starter block 50 and shingle 200 of the present invention provide for increased strength, durability and ease of installation of a shingled roofing system. While particular embodiments of the invention have been shown, it will be understood, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A composite semi-rigid shingle providing an environmental barrier for a roof deck, comprising:

a top surface, a bottom surface, a forward edge and a back edge, the shingle being subdivided into an exposed portion and a headlap portion, the exposed portion extending from the forward edge to the headlap portion and having a central region with a substantially uniform thickness in the longitudinal direction, and the headlap portion extending from the exposed portion to the back edge with a taper in average thickness across the headlap portion moving longitudinally towards the back edge, the taper extending for at least a substantial part of the headlap portion, wherein the thickness of the exposed portion across an entire width of the shingle and the thickness of the headlap portion are substantially equal in a region where the exposed portion transitions to the tapered headlap portion, wherein the headlap portion includes opposed side surfaces, the side surfaces angling laterally inwardly towards one another near the back edge of the shingle to narrow the shingle width moving towards the back edge, wherein the tapering of the headlap portion reduces a peak height of a hidden gap located behind the back edge of the shingle when the shingle is in an underlying course, and wherein each of the opposed side surfaces includes a respective nib extending therefrom, the respective nib on one of the side surfaces being longitudinally offset from the respective nib on the other side surface, such that alignment of the shingle laterally adjacent to another shingle on the roof deck results in a nib of the shingle mating with another nib of the other shingle.

2. The shingle of claim 1 wherein the reduction in the peak height allows the headlap portion of a shingle in an overlying course to have a greater surface area contact with the roof deck.

* * * * *